US005829613A

United States Patent [19]

Wohlgemuth et al.

[11] Patent Number: 5,829,613

[45] **Date of Patent: *Nov. 3, 1998**

[54] SNAP-ON/SCREW-OFF CAP AND NECK CONFIGURATION

[75] Inventors: Emanuel Erick Wohlgemuth, N. Bellmore, N.Y.; Charles Hogan, Spokane, Wash.

[73] Assignee: Superseal Corporation, Condado, Puerto Rico

[ * ] Notice: The term of this patent shall not extend beyond the expiration date of Pat. No. 5,642,825.

[21] Appl. No.: 545,959

[22] Filed: Oct. 20, 1995

Related U.S. Application Data

[63] Continuation-in-part of Ser. No. 517,065, Aug. 21, 1995, Pat. No. 5,642,825.

[51] Int. Cl.[6] ..... B65D 41/47

[52] U.S. Cl. ..... 215/256; 215/330

[58] Field of Search ..... 215/250, 252, 215/256, 320, 330, 901

[56] References Cited

U.S. PATENT DOCUMENTS

| | | | |
|---|---|---|---|
| 5,009,323 | 4/1991 | Montgomery et al. | 215/252 |
| 5,100,011 | 3/1992 | Maietta | 215/256 |
| 5,213,224 | 5/1993 | Luch | 215/256 |
| 5,307,945 | 5/1994 | Hidding et al. | 215/256 X |
| 5,307,946 | 5/1994 | Molinaro | 215/256 X |
| 5,450,972 | 9/1995 | Zemlo | 215/318 X |

FOREIGN PATENT DOCUMENTS

| | | | |
|---|---|---|---|
| 681404 | 10/1952 | United Kingdom | 215/256 |

*Primary Examiner*—Allan N. Shoap
*Assistant Examiner*—Nathan Newhouse
*Attorney, Agent, or Firm*—Hoffmann & Baron, LLP

[57] ABSTRACT

A container closure system comprising a threaded cap and a threaded neck wherein the cap is affixed to the neck by direct axial application so that the mating threads slip past one another and into engagement. The cap further includes sealing means to capture and constrict the outer diameter of the neck, and valve means to plug the container opening in the neck and expand the outer diameter of the neck, so that the sealing means and valve means cooperate to improve sealing of the cap and neck. The cap and neck further include tamper-indication means to prevent removal of the cap without activation thereof.

23 Claims, 21 Drawing Sheets

SNAP-ON/SCREW-OFF CAP AND NECK CONFIGURATION

This is a continuation-in-part of application Ser. No. 08/517,065 filed on Aug. 21, 1995 now U.S. Pat. No. 5,642,825.

FIELD OF THE INVENTION

The present invention is related to caps and neck-finishes for use in blow-molded plastic containers, specifically to caps and neck-finishes configured for snap-on assembly and screw-off disassembly.

BACKGROUND OF THE INVENTION

Blow-molded plastic containers having mating threaded caps and neck-finishes are well known. Blow-molded plastic containers having mating annular features for snap-on assembly and snap-off disassembly are also well known.

Threaded caps offer several advantages over snap-on caps in end use. Threaded caps are tightly sealable in spite of modest dimensional variations in the unpredictably blow-molded neck. Threaded caps may be removed and re-assembled repeatedly with sealing consistency dependent only on the twisting force applied by the user. The sealing strength and reliability of threaded caps is generally superior to that of snap-on caps.

Snap-on caps, however, are more easily adapted for automatic assembly during the bottling process, primarily because relative rotational pre-positioning of the cap and neck is not required, and because only direct axial application of the cap onto the neck without rotation is required to affix the cap onto the neck during bottling. Such cap and neck configurations are therefore desirable in automated bottling applications.

Several attempts have been made in recent years to provide a cap which provides the advantages of both cap attachment methods, allowing direct axial application without rotational pre-positioning to affix the cap during bottling, and allowing the sealing reliability and end-use advantages of threaded engagement, but to date none have been successful in combining the aforementioned advantages while eliminating the aforementioned disadvantages.

Caps providing tamper-indicators are also well known. Screw-off cap designs having frangible rings to rotationally interlock with the container neck and theoretically require removal for cap unscrewing and thereby also provide tamper-indication have been presented in many prior art patents and embodiments.

Prior art cap and neck configurations promising both snap-on/screw-off engagement and frangible tamper-indication have been offered in several prior art patents such as U.S. Pat. Nos. 5,174,465, 5,190,178, 5,285,912, and 5,307,946. Although these and many other prior snap-on/screw-off/tamper-indicating configurations have promised to allow reliably sealing snap-on engagement regardless of the pre-engagement relative rotational positioning of the cap and neck, and have promised to deny unscrewing so long as the indicating means is not actuated, no such configuration heretofore practiced is known to the inventor to have fulfilled such promises.

For instance, in U.S. Pat. No. 5,190,178, a cap and neck-finish configuration is disclosed which provides snap-on assembly, screw-off disassembly and re-assembly, and a tamper-indicating frangible lock ring. Buttress type threads comprised in the neck finish allow the threads of the cap to be axially forced thereover during bottling. Interlocking features comprising voids in the frangible ring and lugs in the neck-finish collar are provided which mate to prevent unintentional rotation and loosening of the cap. With only two allowable relative rotational relationships between the cap and container for direct axial assembly, an orientation feature is and must be provided to pre-align the voids with the collar lugs. During automated bottling, such pre-alignment would be performed by an automatic orientation machine which would be fed randomly positioned caps and would reposition each cap into a predetermined upright and rotational position aligned with the container neck by means of the orientation feature. Such a need for proper pre-alignment is a drawback to the disclosed configuration, as it represents an additional procedure during the bottling process.

Further, although the interlocking of the frangible ring and collar disclosed in U.S. Pat. No. 5,190,178 is intended to require removal of the ring for unscrewing of the cap, the non-continuous frangible engagement partially around the collar has proven in actual embodiment to allow rotational slippage during unscrewing without such frangible removal, thereby circumventing the intended tamper-indication.

In U.S. Pat. Nos. 5,285,912 and 5,307,946, cap and neck-finish configurations are disclosed which provide snap-on assembly, screw-off disassembly and re-assembly, and tamper-indicating frangible lock rings. In both patents, mating seven-lead threads in the cap and neck are disclosed. Both patents promise to provide ease of automatic assembly by allowing direct axial application without pre-alignment of the cap to the neck, to provide more reliable sealing, and to provide true tamper-indication. However, in actual embodiment, the configurations are found prone to leakage and tamper-indication failure due to the potential rotational misalignment of up to one-seventh of a rotation from optimal and due to insufficient sealing of the container opening to allow for the effects of such misalignment. The particular thread configuration disclosed and practiced is found to provide insufficient sealing forces in some relative rotational positions of the cap and neck, and the non-continuous frangible ring engagement partially around the collar is found to allow rotational slippage during unscrewing, thereby circumventing the intended tamper-indication. The one-way rotatable engagement of the frangible rings with the collars of these disclosures and embodiments is imperative, as dictated by the need to allow additional cap tightening after axial assembly on containers found to be leaking during bottling. This ratchet interface allows tightening but not loosening of the cap, and is practically blow-moldable only partially around the collar. The one-way rotatable engagement offers an additional psychological drawback as well, in that end-users often notice that additional tightening is possible and believe that the particular cap was not fully tightened at bottling. Although these drawbacks have been well recognized in the bottling industry, no embodiment has yet been forthcoming which provides sealing reliable enough to obviate the need for the one-directional ratchet interlock and allow full circumferential interlocking. No embodiment has yet been forthcoming which maintains sealing integrity throughout the range of possible variations in the cap and container interface.

As a result of the drawbacks of these prior art cap and neck configurations, the bottling industry today suffers from the lack of an easily attachable and leak-proof cap with true tamper-indication, at great loss and risk.

OBJECTS AND SUMMARY OF THE INVENTION

The present invention is a cap and neck-finish configuration for a blow-molded container adapted to allow more reliable sealing after direct axial assembly without post-tightening, to obviate the need for one-way rotatability of the cap relative to the neck, and to provide positive tamper-indication. Both the cap and neck threads are of the modified Buttress type and opposingly directed to provide improved slip-over during snap-on assembly and improved sealing strength thereafter. The cap and neck each include an eight-lead thread to ensure that the relative rotational position of the cap and neck at the initiation of axial engagement cannot vary more than forty-five angular degrees from optimal final engagement. Both the cap and neck threads are of the same pitch to allow proper thread mating. The eight-lead thread of the cap improves screw-on assembly starting for the user, while improving cap to neck squareness for improved sealing. The cap interior includes an annular wiper which sealingly engages an unthreaded portion of the neck's exterior and a reverse-tapered annular wall depending within and sealingly engaging the neck's opening to provide a sealing valve which cooperates with the wiper seal to capture the neck at both the neck's interior and exterior. The cap further comprises a frangible tamper-indicating ring with forty-five rotational locking lugs which interlock with mating ratchet teeth in the neck's collar. The lug tips are tapered to direct the lugs in-between the ratchet teeth and overcome slight misalignment during assembly, to ensure that the relative rotational position of the cap and neck at final engagement cannot be varied without activation of the tamper-indicator. This lug shape and the disposition of the lugs and teeth completely around the cap and collar facilitates proper interlocking regardless of the relative rotational positioning of the cap and neck. These interlock and thread arrangements provide that the axially assembled cap is not more than one forty-fifth of a revolution from maximum tightness, which is within a sealing range provided by the wiper/valve arrangement. This ensures that the dual interior/exterior sealing is fully engaged whether the cap is at maximum tightness or at maximum possible looseness, so will therefore function regardless of the cap's rotational position prior to assembly. Further, because the lugs and ratchet teeth are disposed completely around the cap and neck, a fully circumferential interlock between the frangible tamper-indicator and the neck collar is provided which yields a more positive interlock and a causes the frangible tamper-indicator to tear from the cap prior to unscrewing for true tamper-indication. As a result of the thread and interlock feature arrangement of the present invention, a snap-on assembly is provided which negates the need for an orientation feature in the cap or a one-way rotatable ratchet, and which provides tight and reliable sealing regardless of the cap's rotational position relative to the neck at assembly.

It is the object of the present invention to provide a cap and neck-finish configuration for a blow-molded plastic container which is more easily adapted for automatic assembly.

It is the further object to provide a snap-on screw-off cap and neck-finish configuration which provides a secure and reliable seal.

It is the further object to provide a snap-on screw-off cap and neck-finish configuration having improved tamper-indication.

It is the further object to provide a snap-on screw-off cap and neck-finish configuration which provides positive sealing, yet does not require or allow post-tightening of the cap.

It is the further object to provide a snap-on screw-off cap and neck-finish configuration having tamper-indication which is easily accessed by both right-handed and left-handed users.

Further objects and advantages of the present invention will be best appreciated and more fully understood in reference to the herein described preferred embodiment and the appended drawings, of which the following is a brief description.

DESCRIPTION OF THE PREFERRED EMBODIMENT OF THE INVENTION

The preferred embodiment of the present invention is depicted in FIGS. 1 through 11J.

Figure 1:
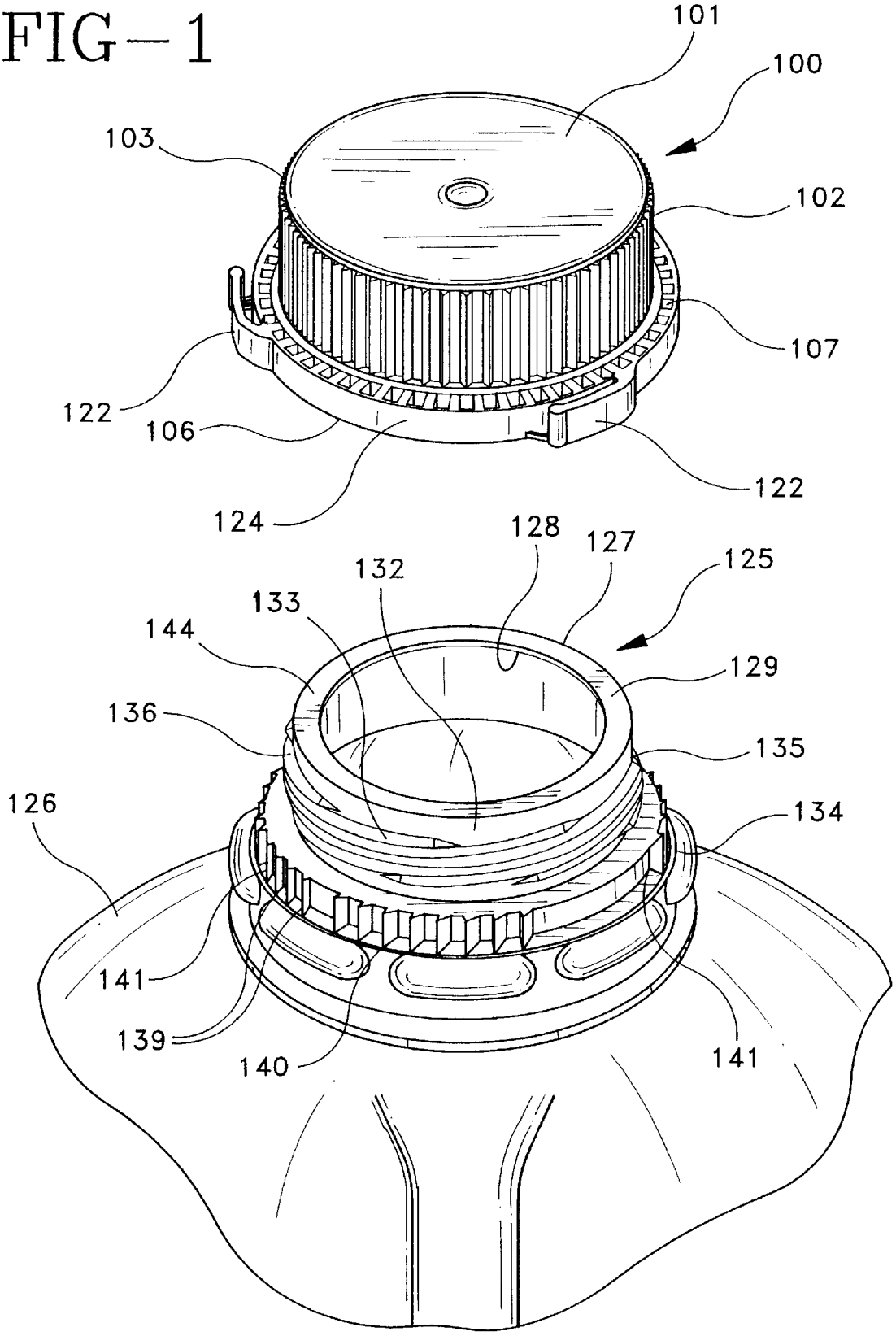
FIG. 1 is an exploded perspective view of a cap and a container in accordance with the present invention.
Figure 2:
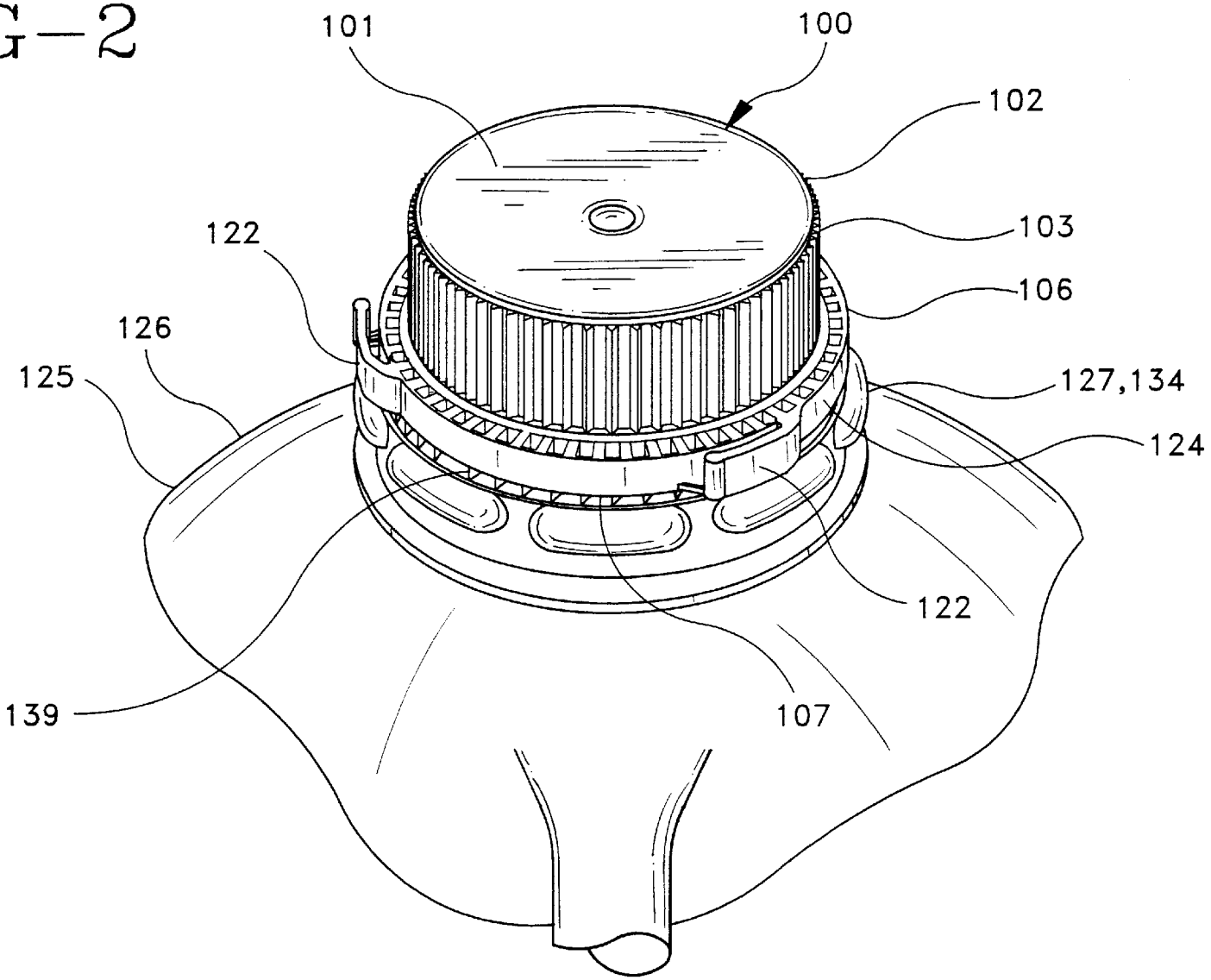
FIG. 2 is an assembled perspective view of the cap and container of FIG. 1.
Figure 3:
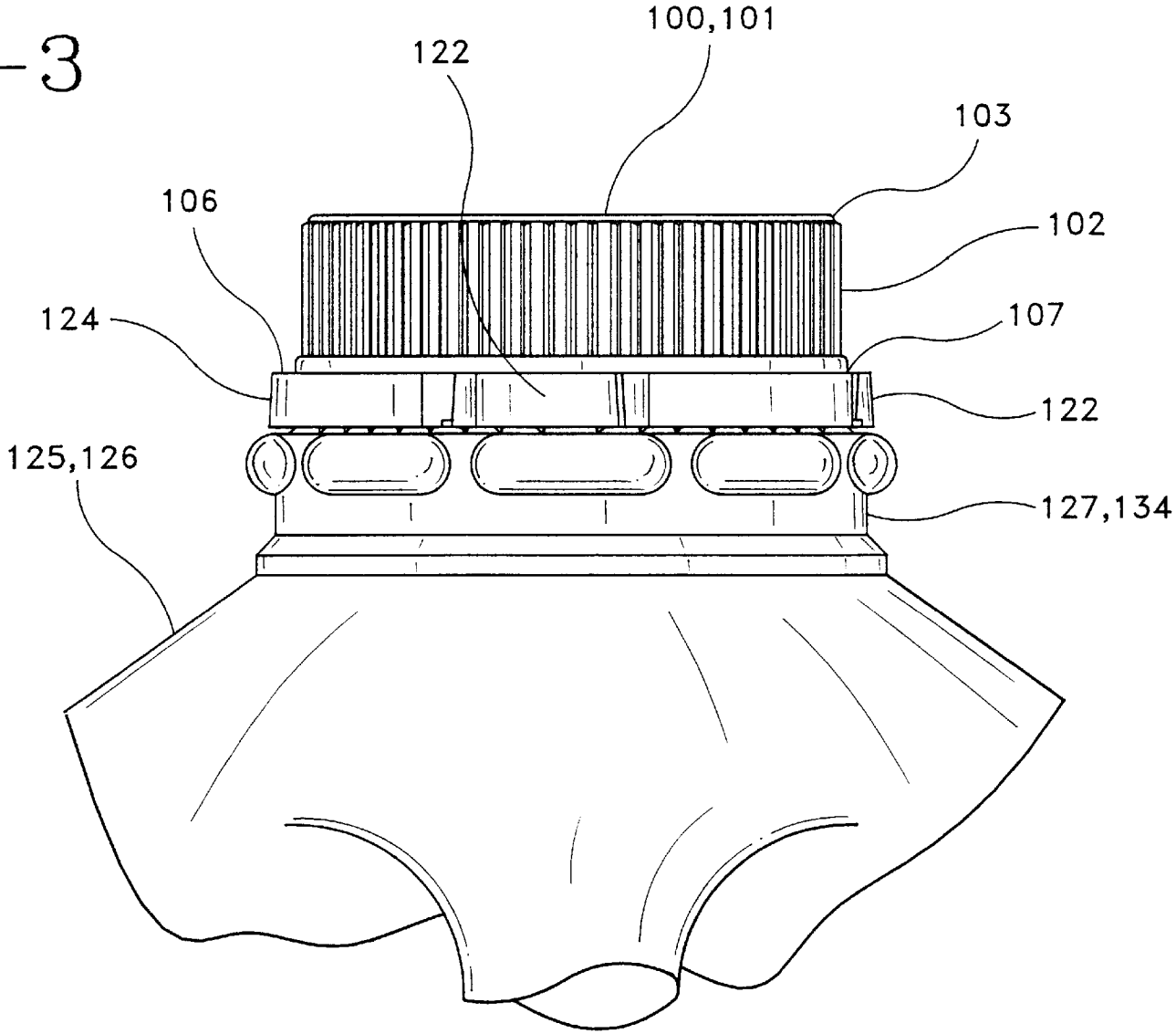
FIG. 3 is an assembled side view of the cap and container of FIG. 1.
Figure 4A:
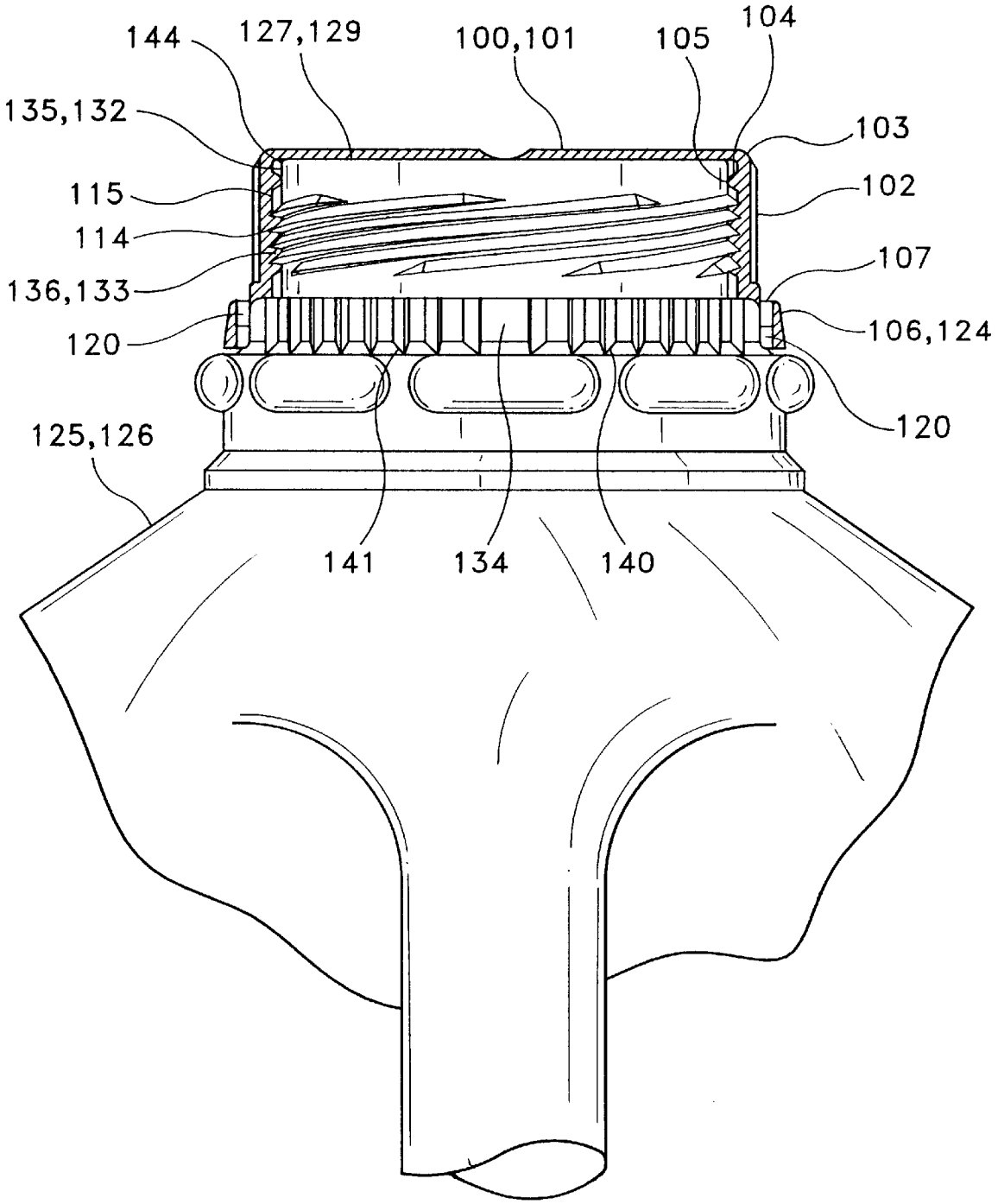
FIG. 4A is a full sectional side view of the cap and container of FIG. 1.
Figure 4B:
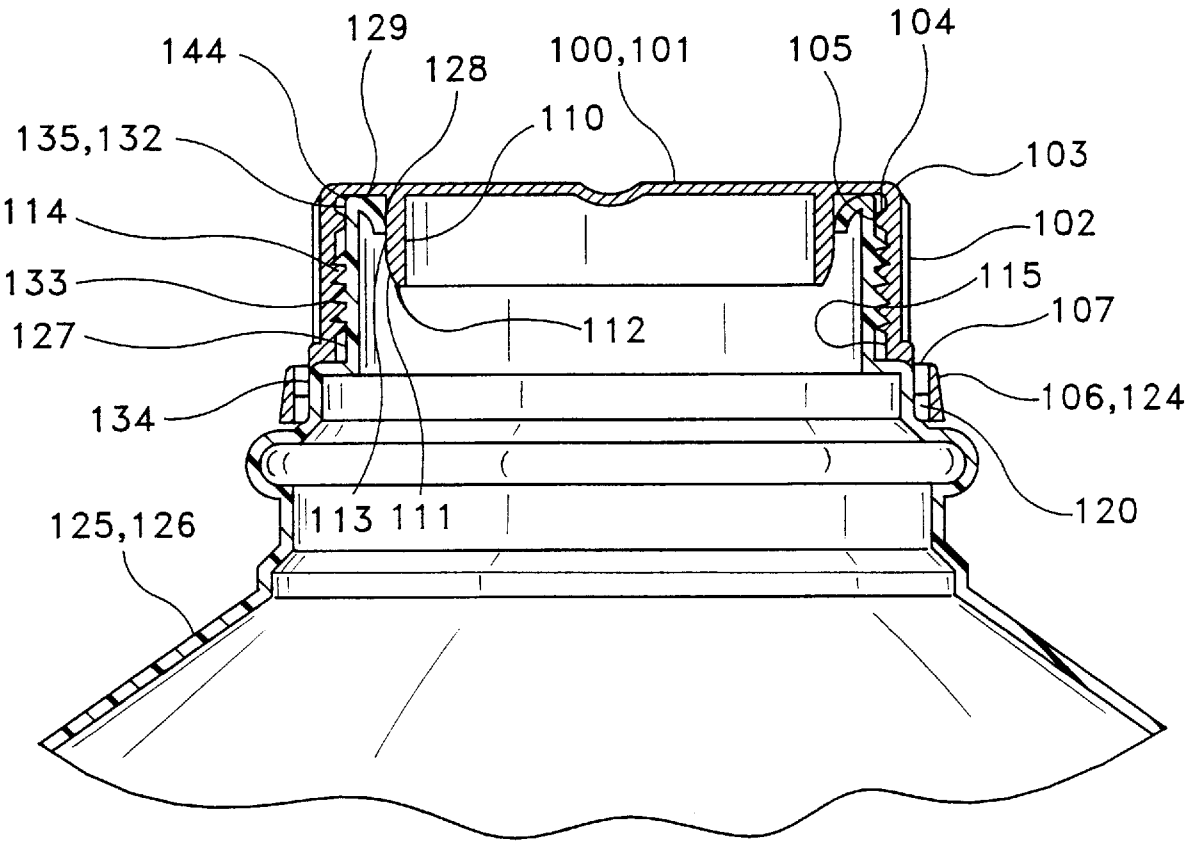
FIG. 4B is a partial sectional side view of the cap and container of FIG. 1.
Figure 5:
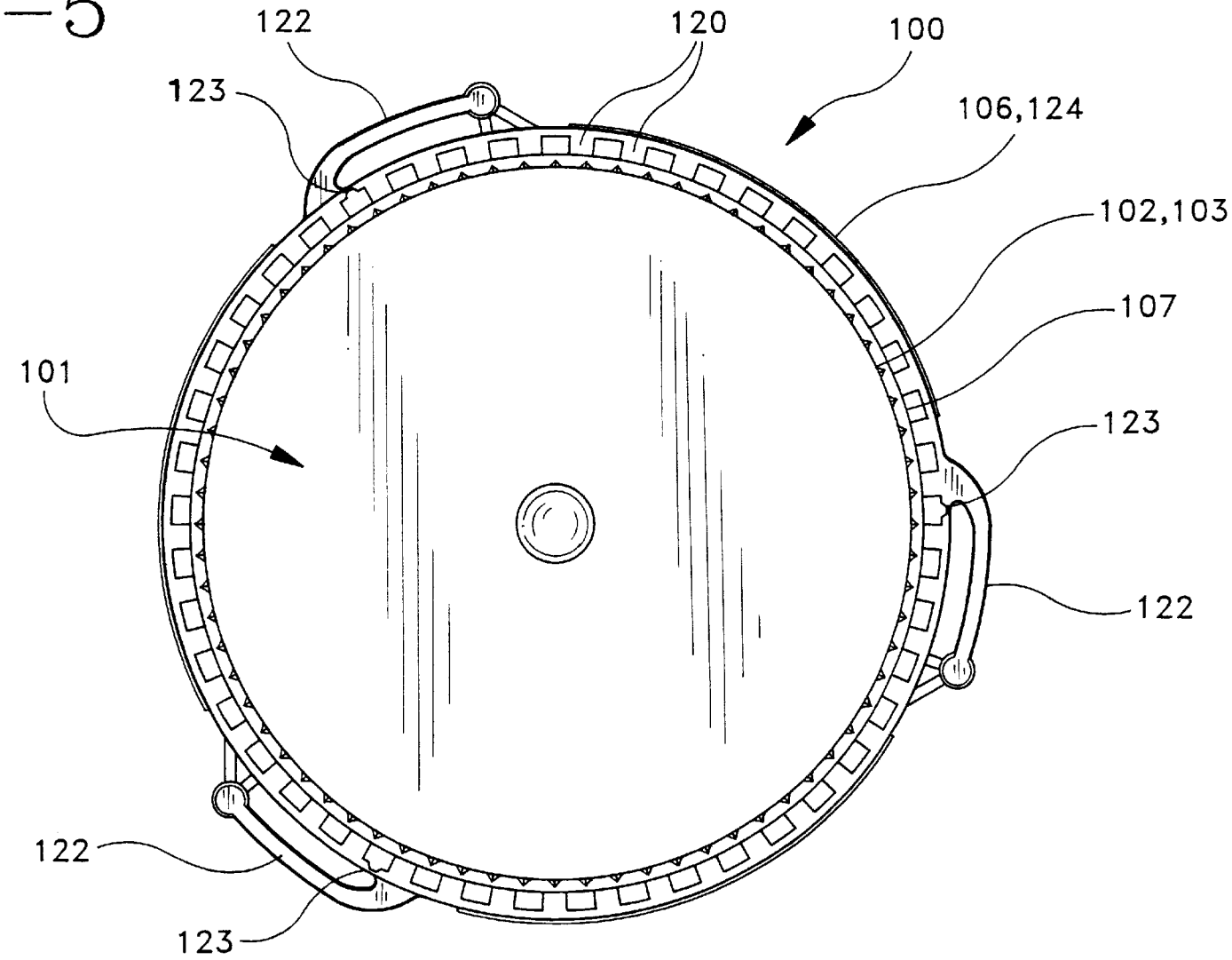
FIG. 5 is an top view of the cap of FIG. 1.
Figure 6:
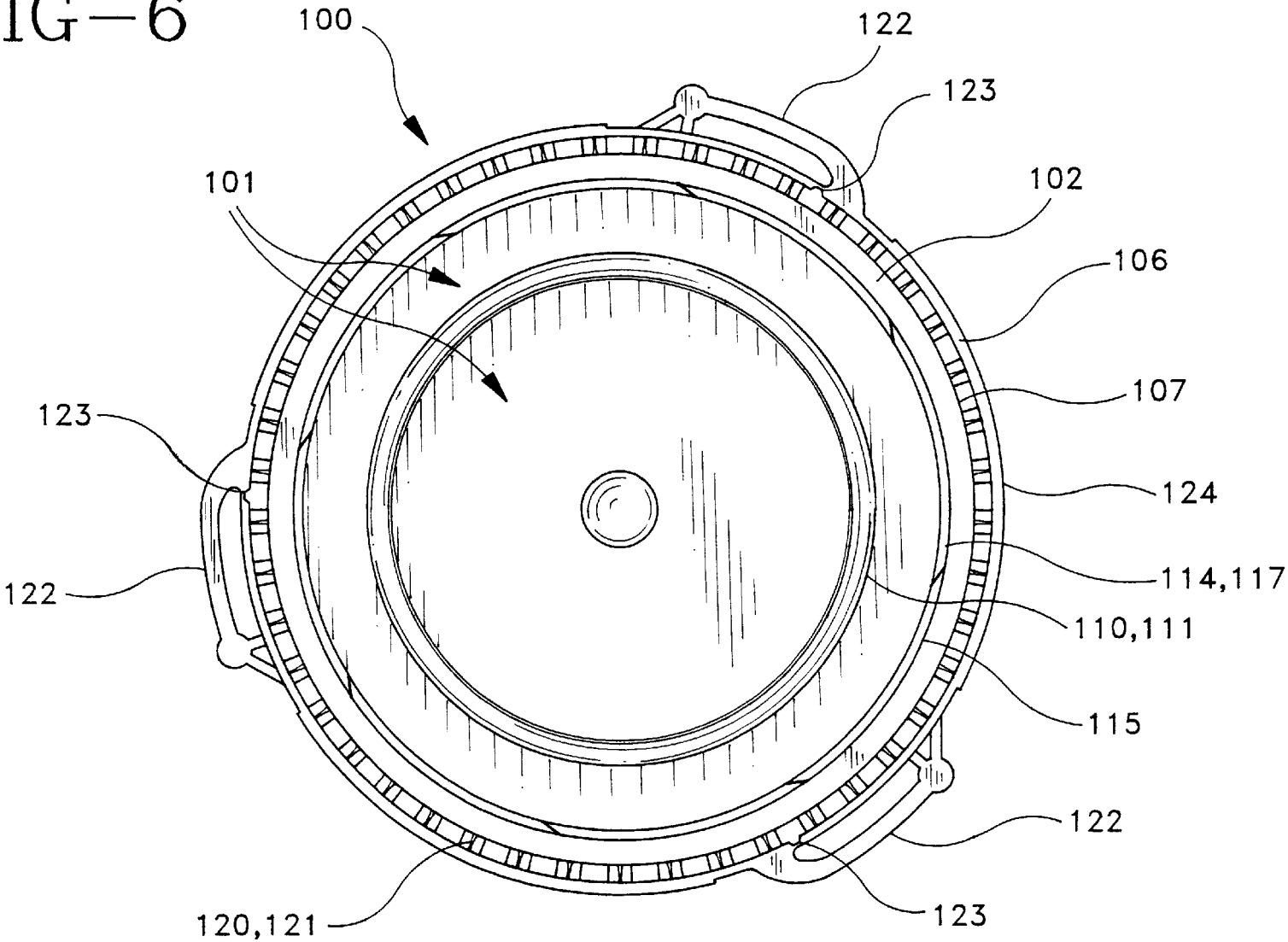
FIG. 6 is an bottom view of the cap of FIG. 1.
Figure 7:
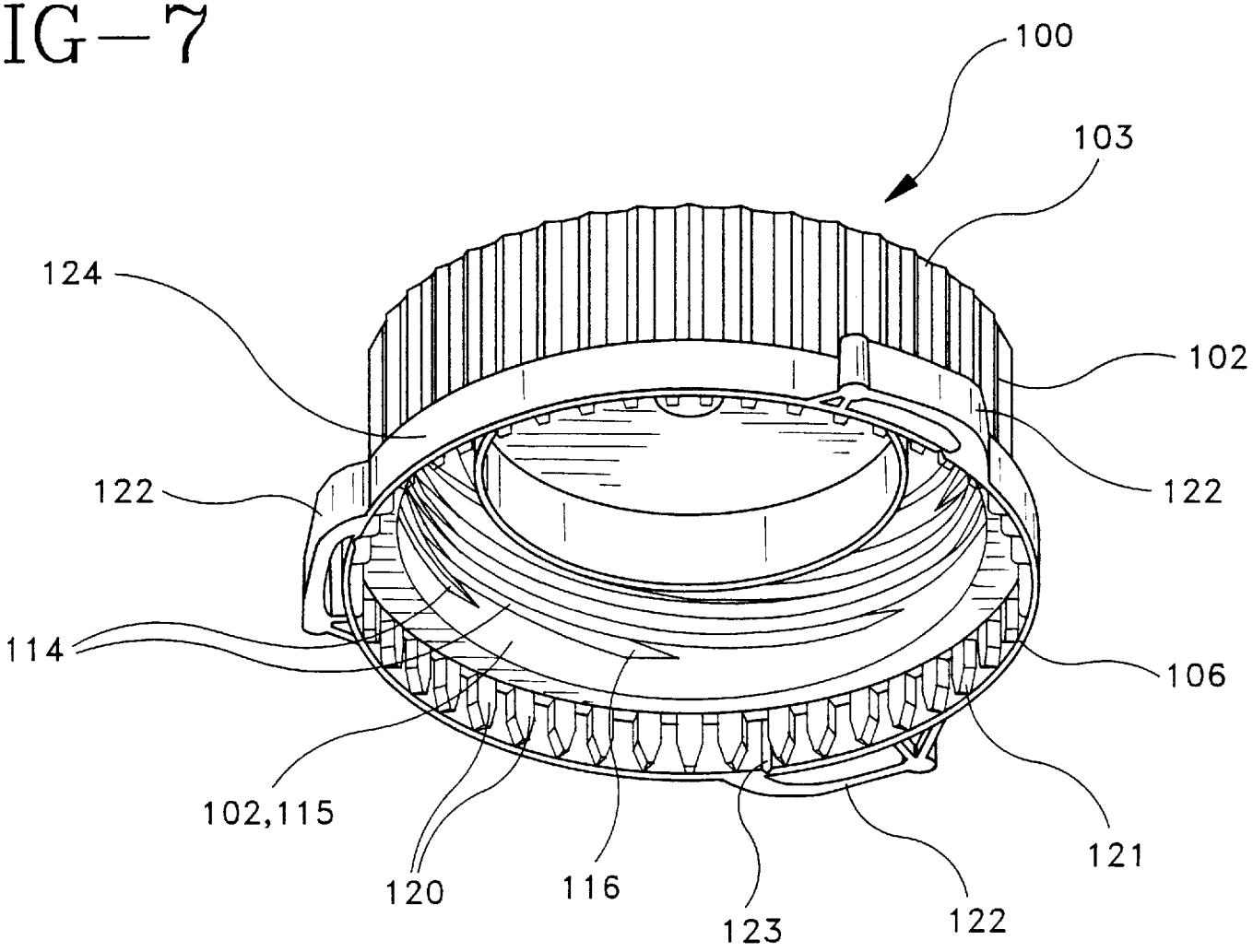
FIG. 7 is an bottom perspective view of the cap of FIG. 1.
Figure 8:
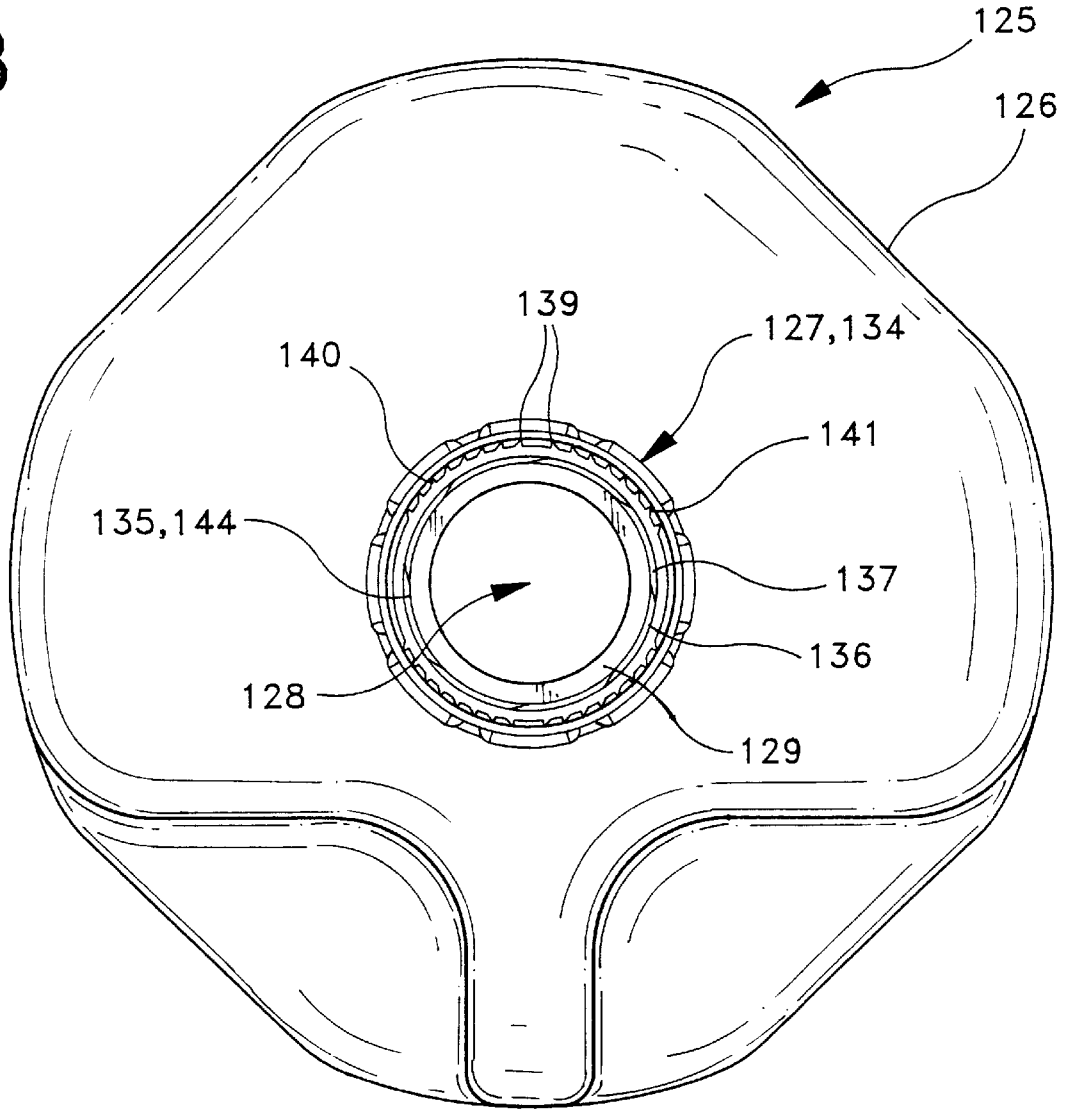
FIG. 8 is an top view of the container of FIG. 1.
Figure 9:
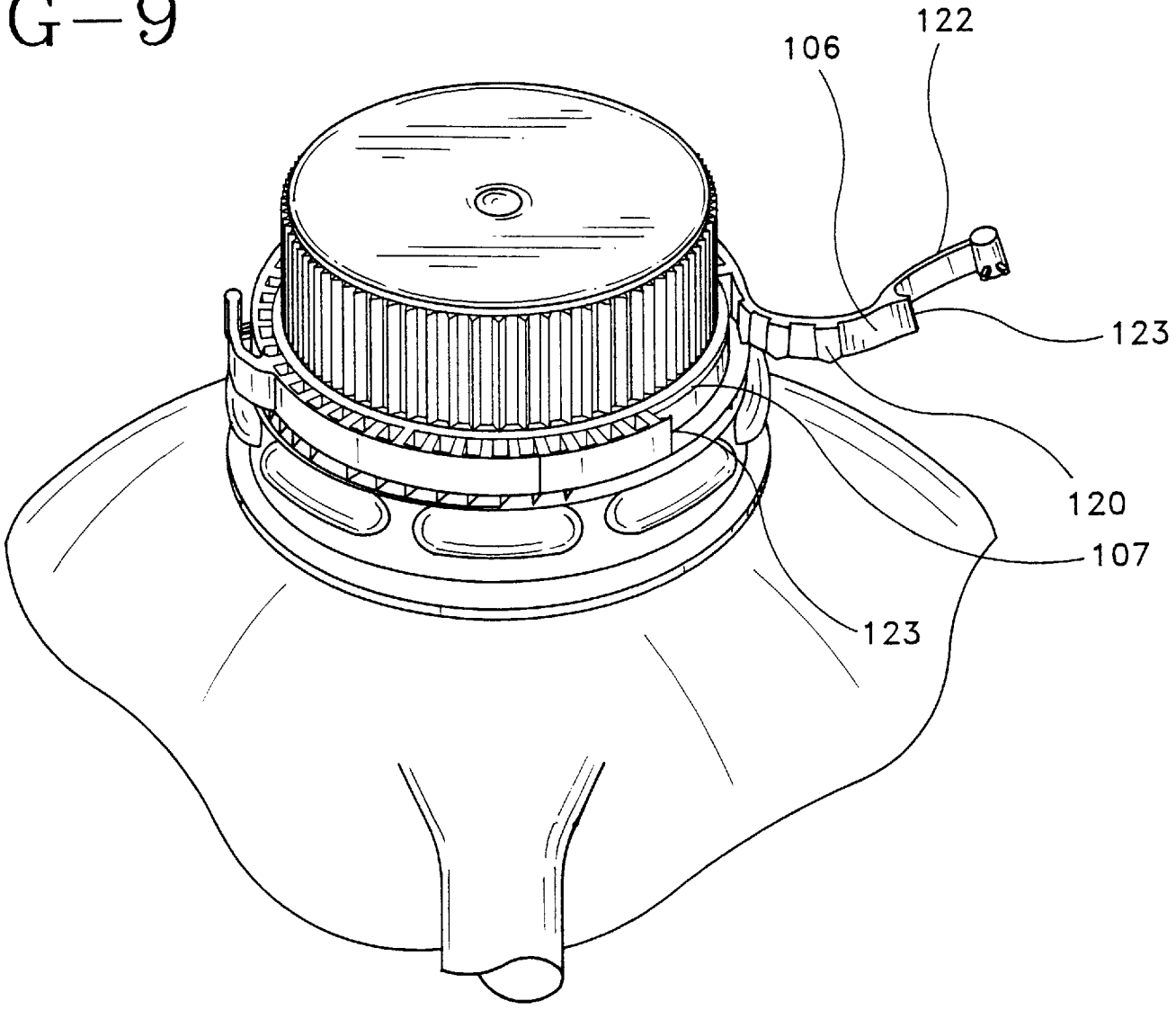
FIG. 9 is an assembled perspective view of the cap and container of FIG. 1 having the tamper-indicating ring partially removed.
Figure 11A:
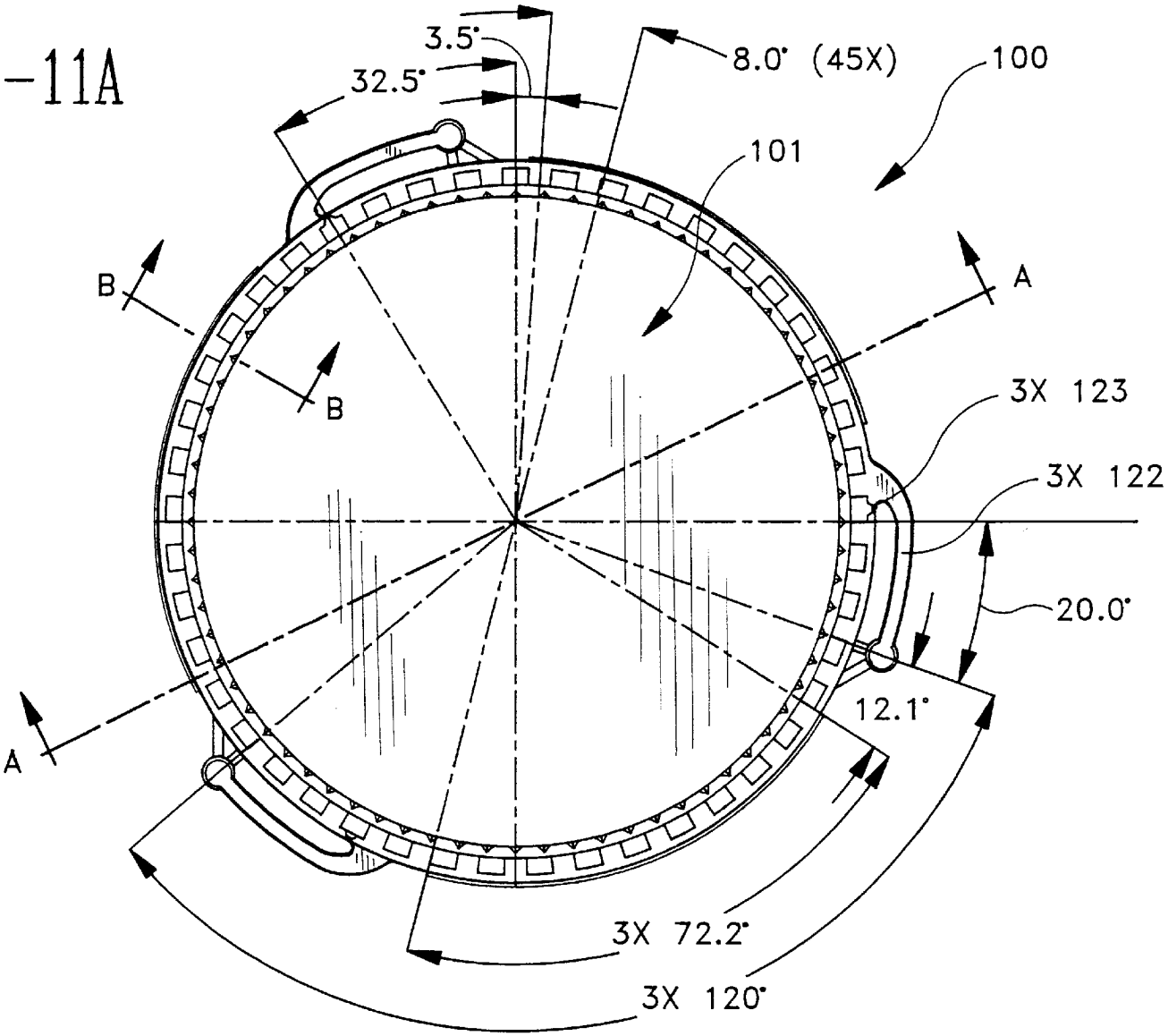
FIG. 11A is a dimensioned top view of the cap of FIG. 1.
Figure 11B:
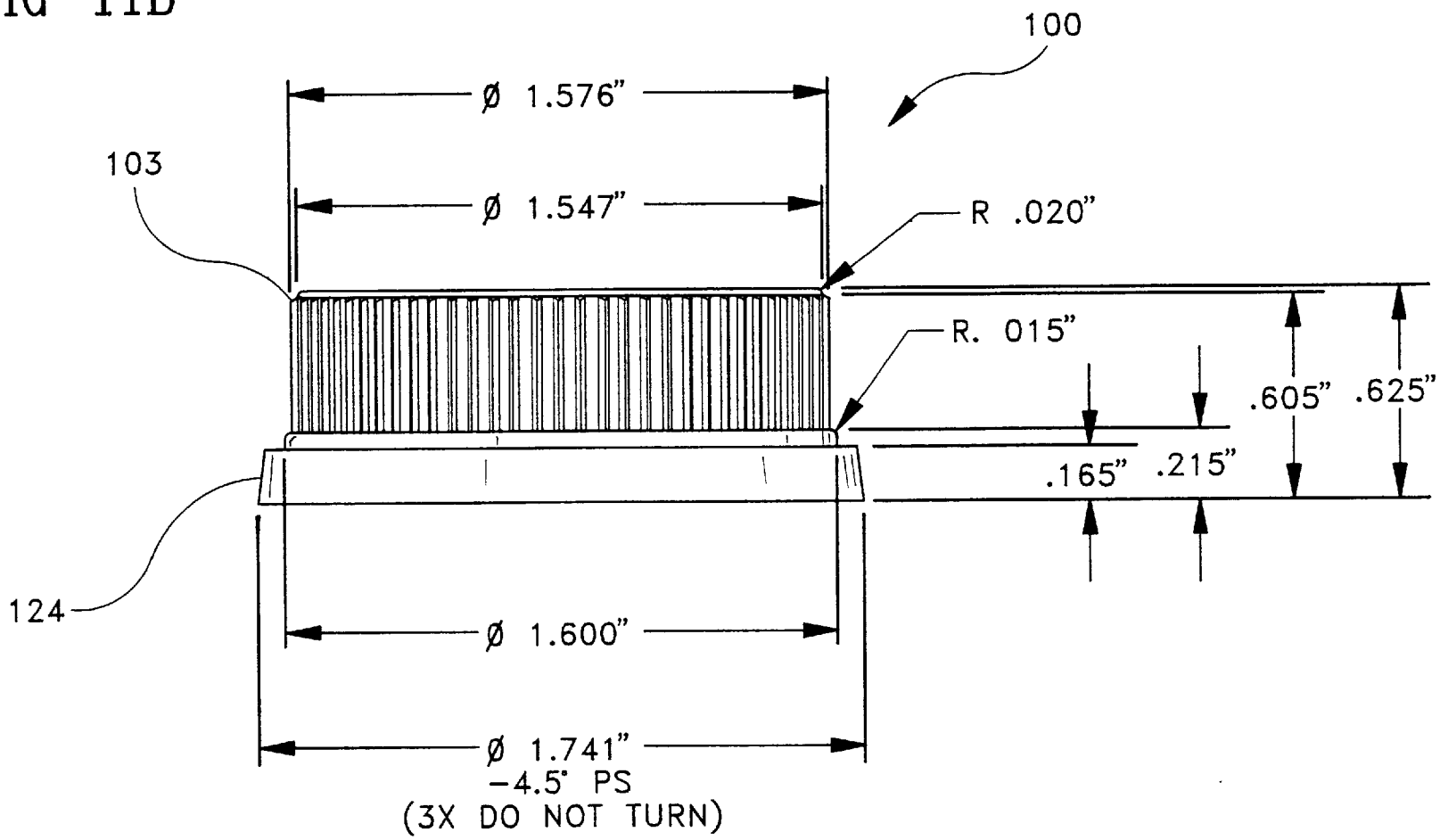
FIG. 11B is a dimensioned side view of the cap of FIG. 1.
Figure 11C:
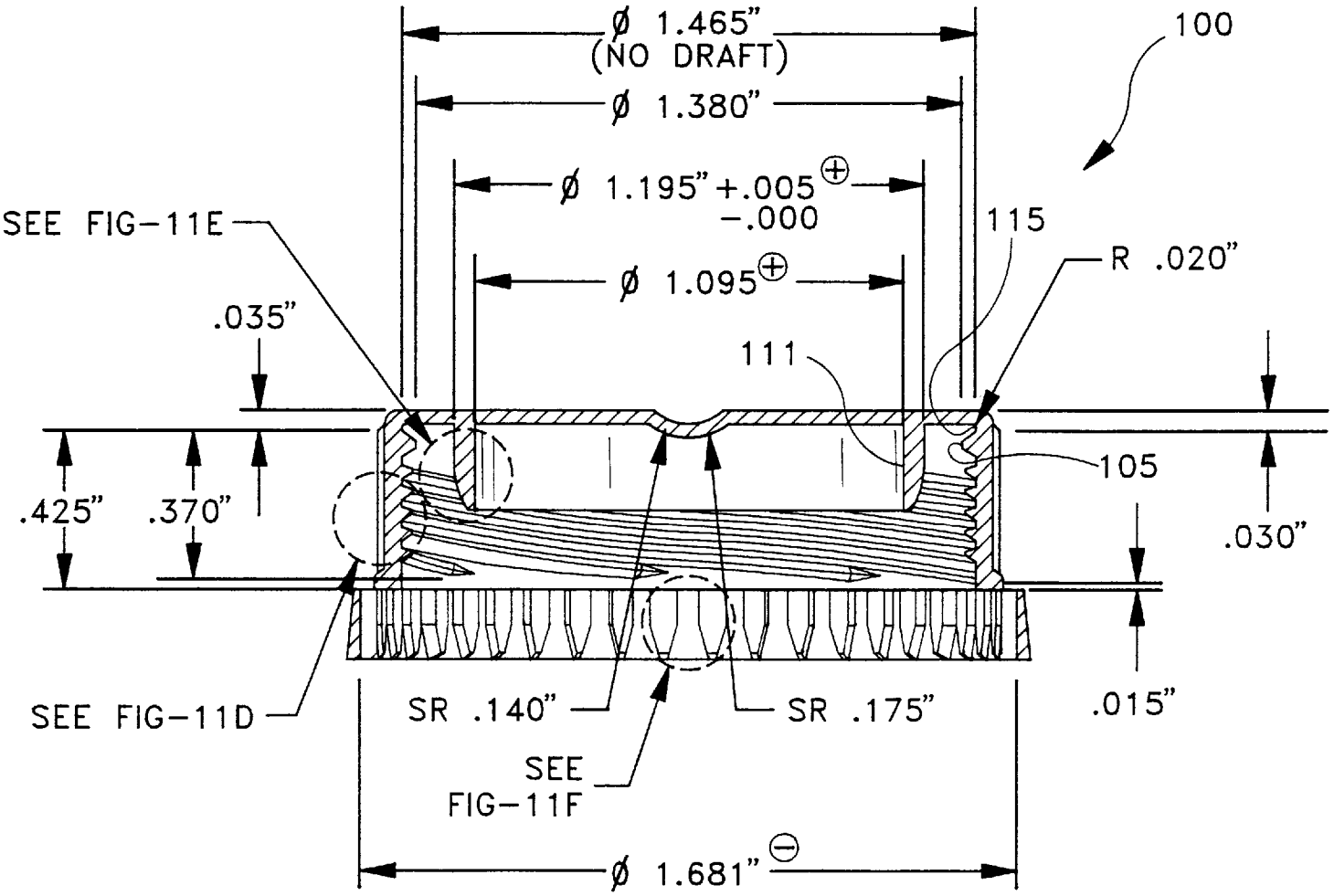
FIG. 11C is a dimensioned sectional view of the cap of FIG. 1.
Figure 11D:
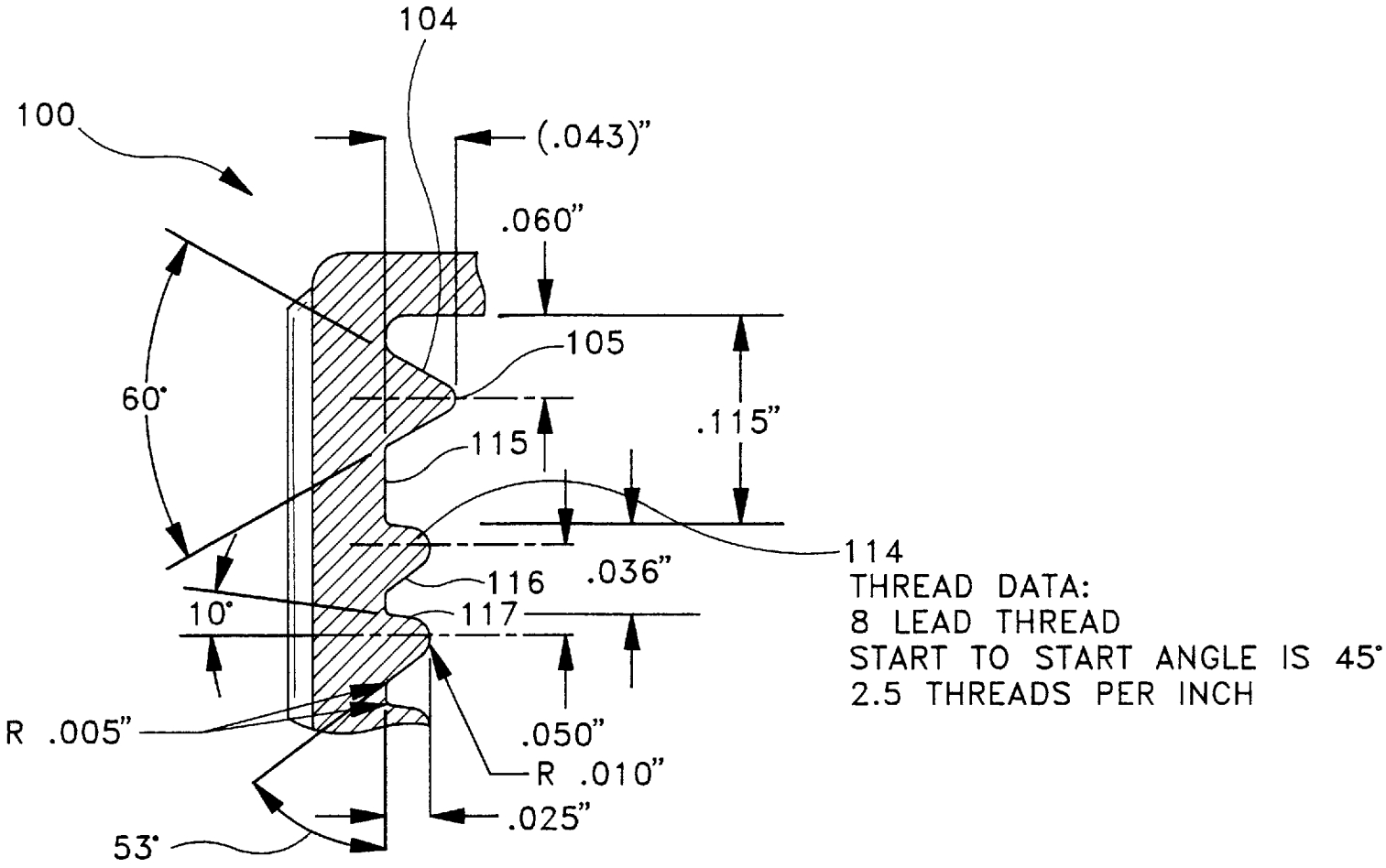
FIG. 11D is a dimensioned partial sectional side view of the threads and wiper of the cap of FIG. 1, drawn at a scale of ten-to-one.
Figure 11E:
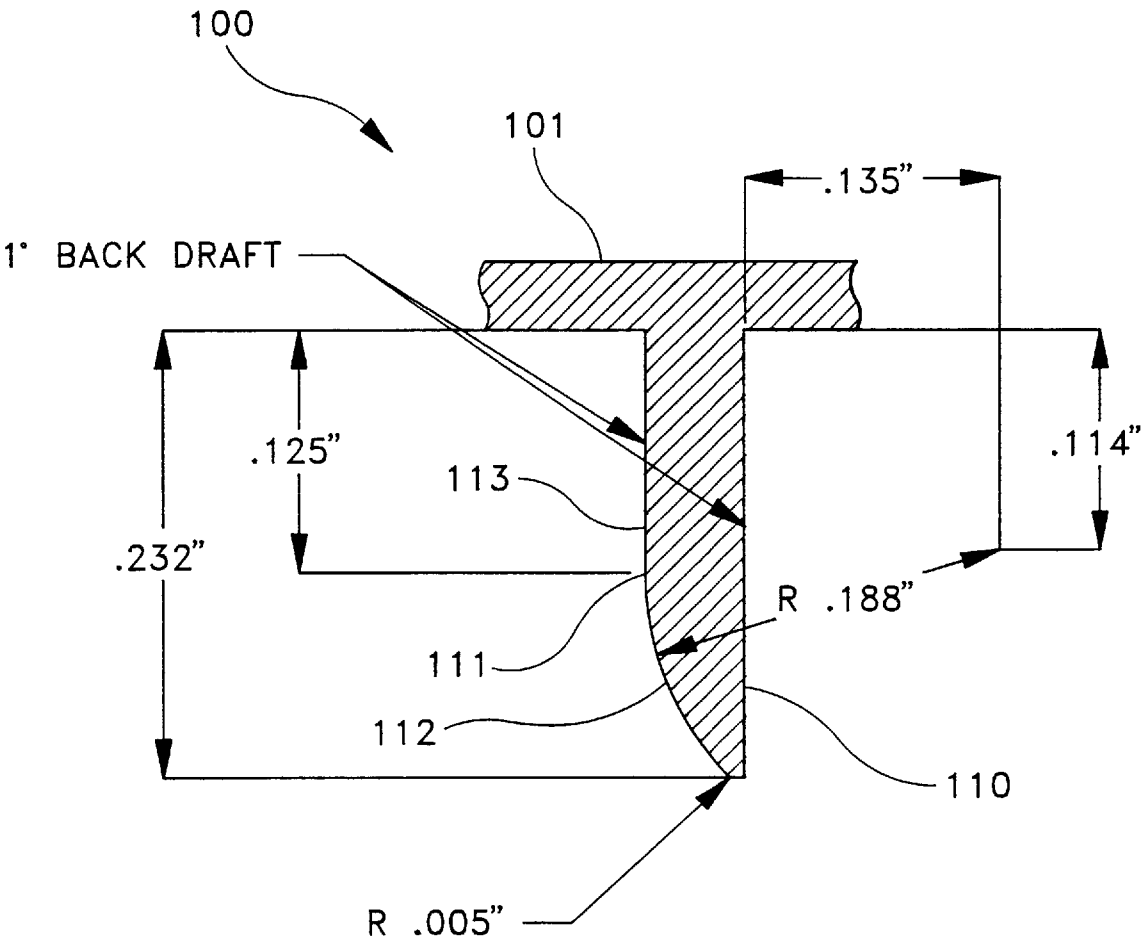
FIG. 11E is a dimensioned partial sectional side view of the valve wall of the cap of FIG. 1, drawn at a scale of ten-to-one.
Figure 11F:
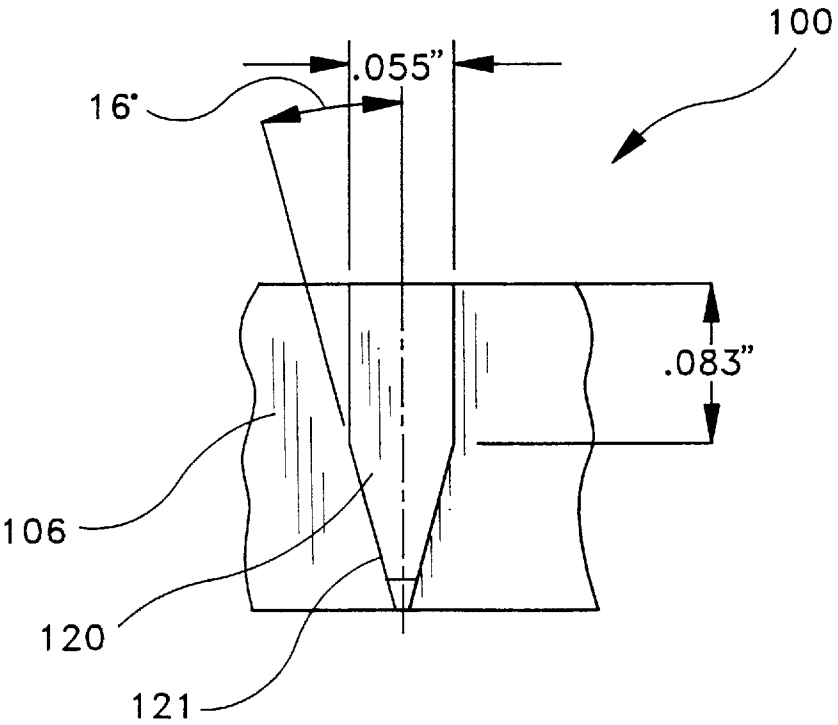
FIG. 11F is a dimensioned interior view of a lug of the cap of FIG. 1, drawn at a scale of ten-to-one.
Figure 11G:
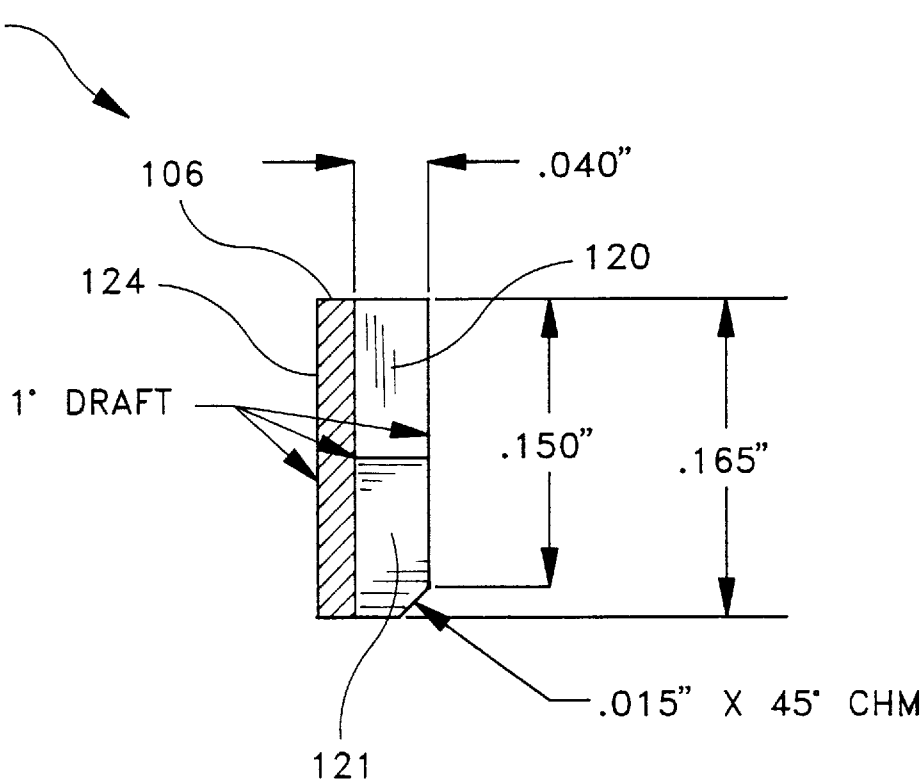
FIG. 11G is a dimensioned partial sectional side view of a lug of the cap of FIG. 1, drawn at a scale of ten-to-one.
Figure 11H:
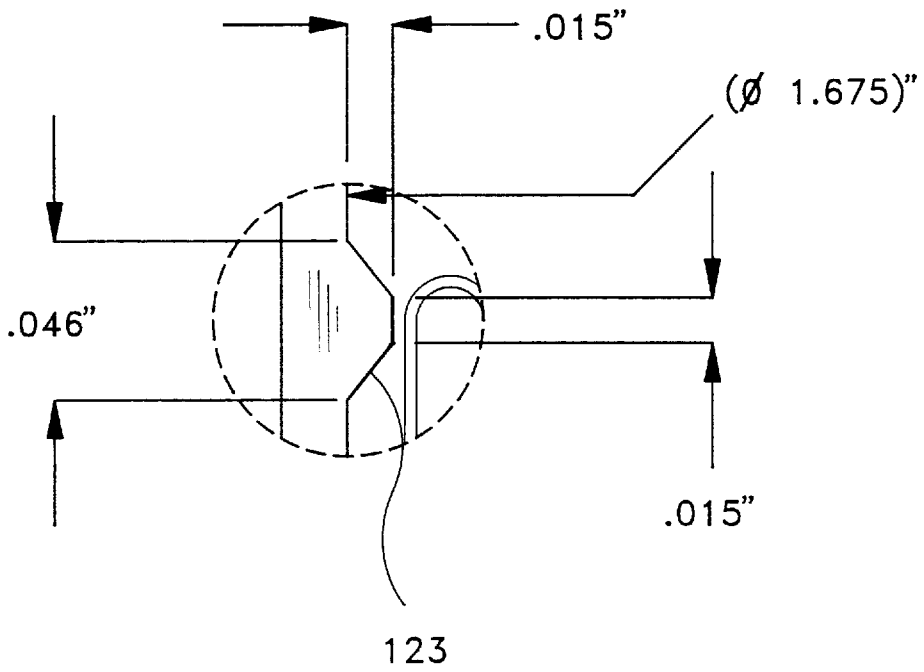
FIG. 11H is a dimensioned top view of a vertical tear grove of the cap of FIG. 1, drawn at a scale of ten-to-one.
Figure 11J:
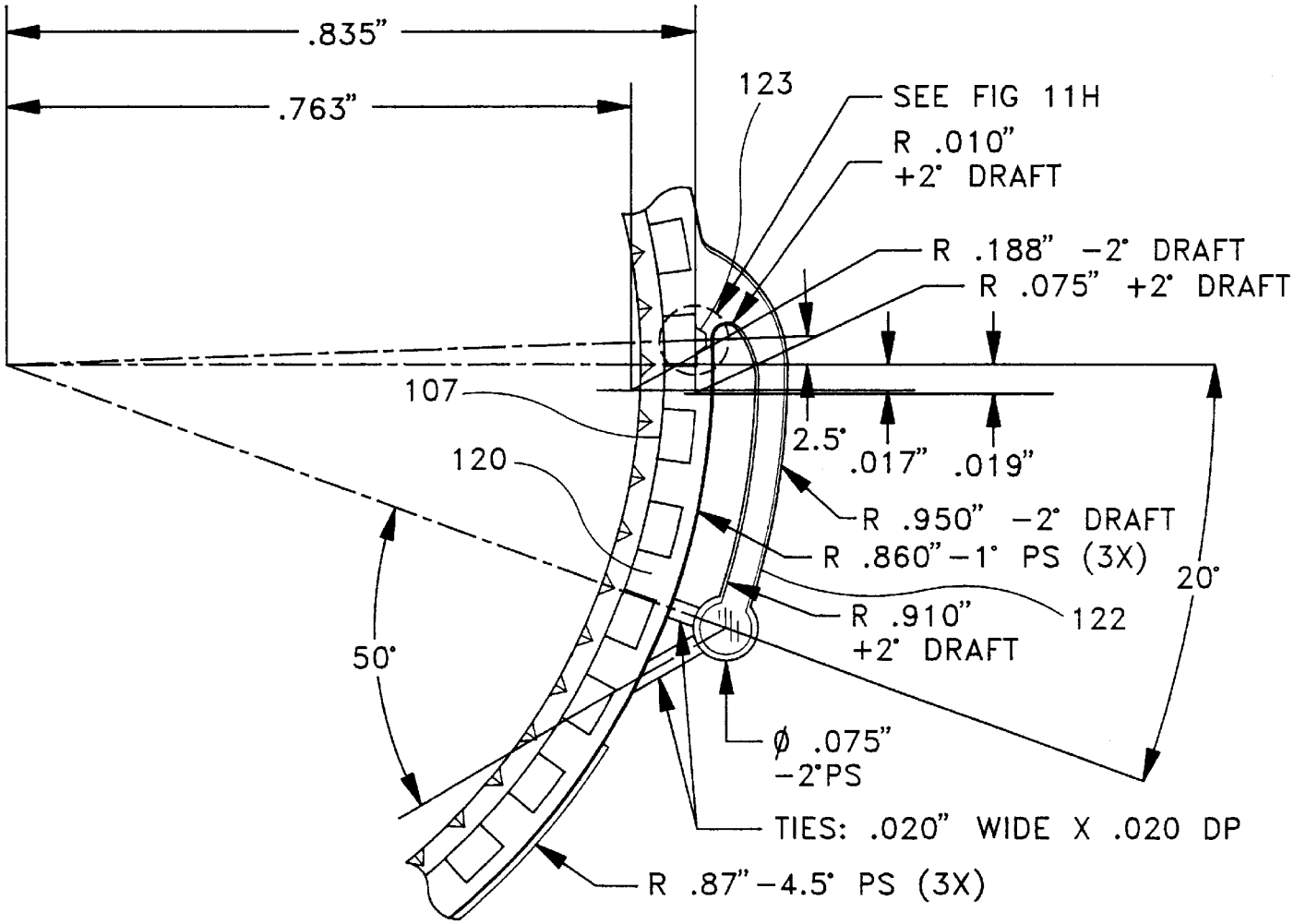
FIG. 11J is a dimensioned top view of a pull-tab of the cap of FIG. 1, drawn at a scale of five-to-one.

Cap 100 comprises a plano-circular top 101 having a cylindrical upper skirt 102 depending downwardly from the top's periphery 103. The upper skirt includes annular sealing bead 104 disposed adjacent the cap top and directed horizontally inward to the bead's inner diameter 105. A cylindrical lower skirt 106 is frangibly attached to the upper skirt at annular tear line 107. Also depending from the cap top is annular valve tube 110, having an outer diameter 111 concentric with and spaced inwardly from the upper skirt. The valve tube's outer surface is substantially spherical at it's lower end 112, as shown in FIG. 11E, and reverse-tapered at it's upper end 113, with it's maximum horizontal diameter 111 disposed below the annular sealing bead. The upper skirt 102 further includes eight helical internal threads 114, arranged equally about the inner diameter 115 of the skirt to form an eight-threaded screw-thread having each thread separated about the cap forty-five angular degrees. Reference to FIG. 11D shows that the threads approximate the Modified-Buttress type, each having steep lead surface 116, sloped fifty-three angular degrees below horizontal, and shallow engagement surface 117, sloped ten angular degrees above horizontal. The lower skirt 106 includes forty-five internal lugs 120 equally disposed about the skirt, each having tapered lower tips 121. The lugs are best understood by reference to FIGS. 11F and 11G. The lower skirt further includes three pull tabs 122, each adjacent a vertical tear groove 123, and equally disposed about the outer diameter 124 of the lower skirt. The preferred embodiment having three pull tabs provides that at least one pull tab will be convenient to the user regardless of the direction at which the cap is approached. This benefit adapts the cap well to both right-handed and left-handed users. The vertical tear grooves are somewhat stronger than the annular tear line 107, and the ring is thereby adapted so that pulling on a pull tab will first break the adjacent vertical tear groove, then break the annular tear line all around with the remaining vertical tear grooves remaining intact, as depicted in FIG. 9.

Figure 10A:
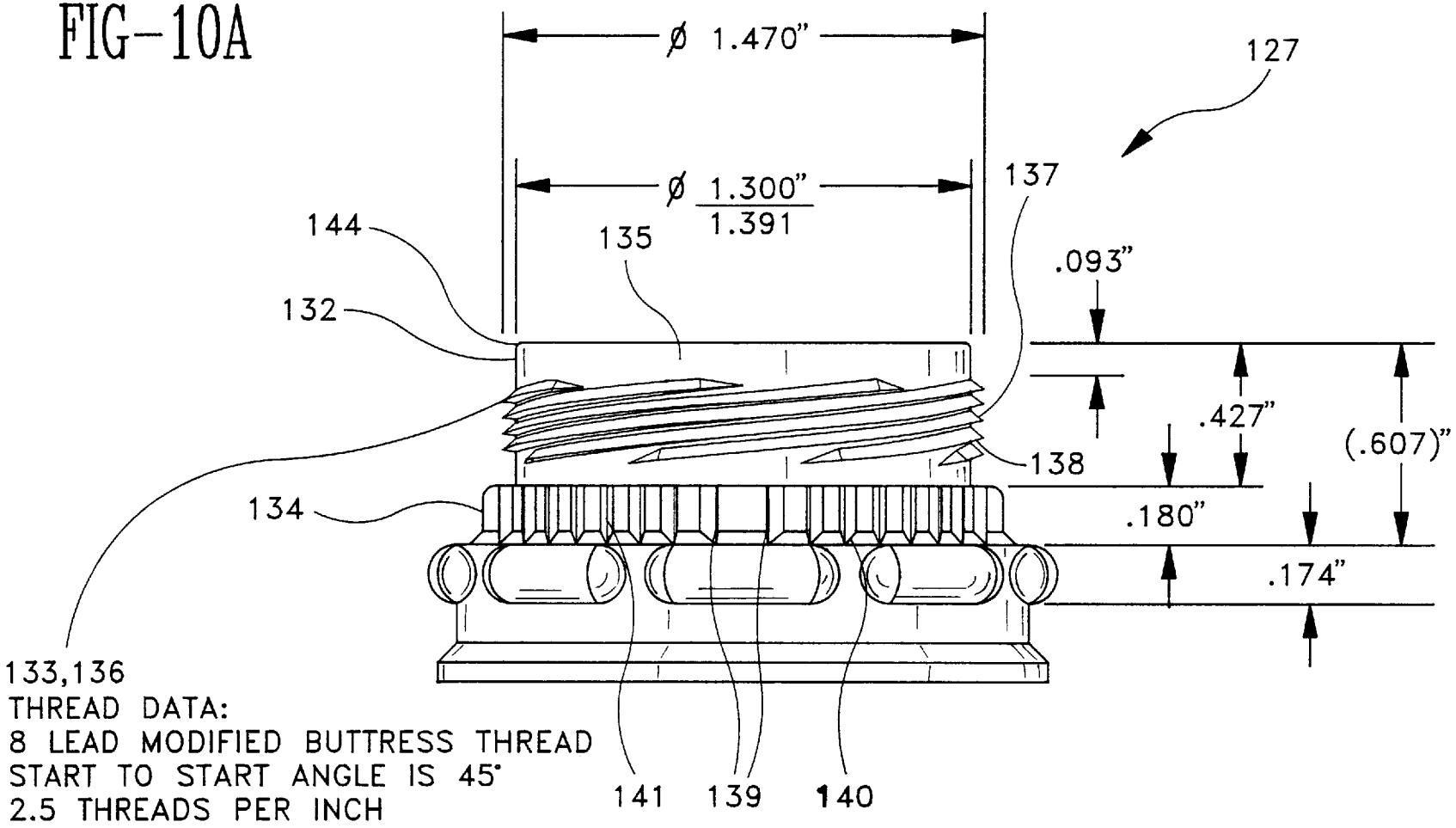
FIG. 10A is a dimensioned side view of the neck of the container of FIG. 1.
Figure 10B:
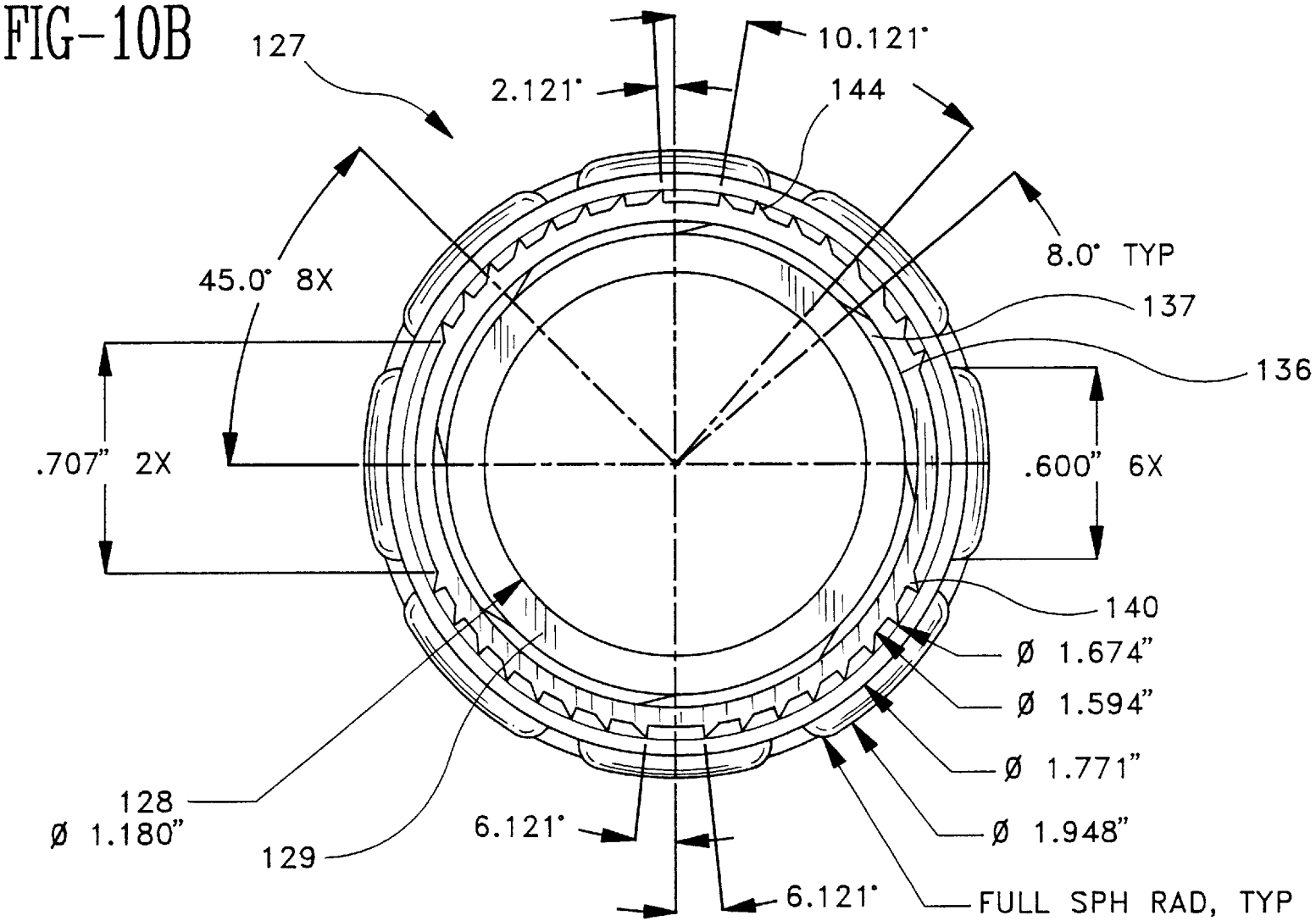
FIG. 10B is a dimensioned top view of the neck of the container of FIG. 1.

The container 125 is a typical blow-molded bottle 126 having a centrally disposed neck 127. The neck is substantially cylindrical and includes circular opening 128 through the top thereof, such that inwardly directed annular flange 129 is formed. The neck opening is slightly smaller in diameter than the horizontal diameter 111 of the cap's spherical valve tube. Depending downwardly from the neck's upper periphery is a cylindrical stretch 132, then a threaded stretch 133, then a collar 134, the collar being adjacent the container bottle 126. The outer diameter 135 of the cylindrical stretch is slightly larger than the cap sealing bead's inner diameter 105. The threaded stretch includes eight helical external threads 136, arranged equally about the outer diameter of the stretch to form an eight-threaded screw-thread having the threads separated about the neck forty-five angular degrees. Reference to FIG. 10A shows the threads are of the Modified-Buttress type, each having steep lead surface 137 and shallow engagement surface 138, these surfaces being oppositely directed from those of the cap. The collar includes thirty-two ratchet teeth 139 grouped about the collar to accept and engage the cap's lugs 120. Clockwise ratchet teeth 140 retain the lugs from counter-clockwise rotation, and counter-clockwise ratchet teeth 141 retain the lugs from clockwise rotation.

Assembly of the cap and neck is accomplished by direct axial application of the cap onto the neck, and is depicted in FIGS. 2 through 4B. The lead-in surface of each cap thread slips past and snaps over the lead-in surface of each neck thread. The tapered lower tips of the lugs direct the lugs in-between adjacent ratchet teeth, and the lugs become fully engaged with the ratchet teeth as the valve tube is forced into the neck opening. The neck opening is firmly and sealingly stretched around the valve wall. Simultaneously, the sealing bead of the cap engages the neck's cylindrical stretch and the smaller inner diameter of the bead is firmly pulled over the larger diameter of the cylindrical stretch. The larger diameter of the valve tube interferes with and expands the smaller neck opening so that the upper periphery 144 of the neck's cylindrical stretch is enlarged slightly in diameter and further seals against the bead.

The sealing effect is enhanced by the cooperation of the valve tube/opening interference fit and the bead/cylindrical stretch interference fit. The outward pressure on the opening by the valve acts to enlarge the neck's upper periphery above the bead, improving sealing and engagement of the cap and neck. Inward pressure of the bead on the cylindrical stretch acts to reduce the opening diameter above the valve tube's maximum diameter, improving sealing and engagement of the cap and neck.

The vertical disposition of the bead ensures that it will always lie around the cylindrical stretch regardless of the rotational relationship between the cap and neck at assembly. The eight-thread configuration allows that the cap's rotational position relative to the neck may vary within forty-five rotational degrees. The lead of the eight-thread screw at two and one-half threads per inch is four-tenths of an inch, so that the pitch of the thread arrangement is fifty-thousandths of an inch. The caps axial position relative to the neck may thereby vary within that fifty-thousandths. The vertical disposition of the bead must therefore be no less than fifty-thousandths of an inch below the upper periphery of the cylindrical stretch in its intended position. The cylindrical stretch must be a minimum of fifty-thousandths of an inch tall to accomondate all possible dispositions of the bead.

Axial removal of the cap from the neck is denied by the mating of the neck's and cap's thread engagement at the respective engagement surfaces. Because rotation is also denied while the lower skirt and upper skirt are intact, by the engagement of the lugs and ratchet teeth, the cap cannot be removed and firm sealing is maintained.

Removal of the cap's lower skirt 106, as depicted in FIG. 9, allows rotation of the cap relative to the neck and the cap can be unscrewed and removed. Removal of the lower skirt further provides tamper-indication by alerting the user that the cap has likely been removed since initial assembly.

Re-attachment of the cap is accomplished by rotational screwing, wherein the sealing system re-engages with each subsequent re-attachment.

Those skilled in the art will recognize that there are many variations of the invention that are within the scope of the invention, therefore, the invention is to be defined only by the limitations and the equivalents thereof which the following claims set forth.

I claim:

1. In combination, a container neck and a container cap, said container neck having an upper opening, a first threaded neck portion depending downwardly from said upper opening and having at least one external thread, and a second neck portion depending downwardly from said threaded neck portion, said second neck portion including external anti-rotation means; and said container cap having a top surface, an upper skirt portion depending downwardly from said top surface, said upper skirt portion having at least one internal thread, and a lower skirt portion depending downwardly from said upper skirt and integrally connected thereto via a frangible line of weakness, said lower skirt portion including internal anti-rotation means;

wherein said cap is affixable to said container neck by direct axial displacement without rotation of said cap relative to said neck such that said internal and external threads interengage and said external and internal anti-rotation means interengage, said external and internal anti-rotation means including means for preventing both clockwise and counter-clockwise rotation of the cap relative to the container neck when said external and internal anti-rotation means are interengaged.

2. The combination of claim 1, wherein the internal and external anti-rotation means comprises mating abutment members on said lower skirt of said cap and said second neck portion of said container.

3. The combination of claim 1, wherein the lower skirt portion includes at least one pull-tab to facilitate removal of said lower skirt from said upper skirt along said line of weakness thereby permitting removal of the cap from the container neck.

4. The combination of claim 1, wherein the external anti-rotation means comprises at least two ratchet teeth which are sloped in opposite directions for interengagement with the internal anti-rotation means of said cap.

5. The combination of claim 1, wherein the internal anti-rotation means comprises at least two abutment members projecting radially inwardly.

6. The combination of claim 5, wherein the abutment members include two parallel sidewalls, each of said sidewalls being tapered to form a point at a lower end of the lower skirt.

7. The combination of claim 1, wherein the lower skirt portion includes at least three pull-tabs symmetrically disposed thereabout, the lower skirt further including a tear initiation groove adjacent each of said pull-tabs, whereby a pulling force on one of said pull-tabs breaks said corresponding tear initiation groove thereby facilitating annular tearing along the frangible line of weakness to separate the lower skirt portion from the upper skirt in one continuous strip.

8. The combination of claim 1, wherein each of the internal and external threads comprises eight leads each and are modified buttress threads.

9. The combination of claim 1, wherein the container cap includes an annular valve tube depending downwardly from the top surface of said cap, the valve tube providing a seal with said container opening when said cap is affixed to said container neck.

10. In combination, a container neck and a container cap, said container neck having an upper opening, a first threaded neck portion depending downwardly from said upper opening, and a second neck portion depending downwardly from said threaded neck portion, said second neck portion including at least one abutment member; and said container cap having a top surface, an upper skirt portion depending downwardly from said top surface, said cap including an annular valve tube depending downwardly from the top surface of said cap, the valve tube providing a seal with said upper opening of the container neck when said cap is affixed to said container neck, said upper skirt portion having at least one internal thread, and a lower skirt portion depending downwardly from said upper skirt and integrally connected thereto via a frangible line of weakness, said lower skirt portion including at least one abutment member for engagement with the at least one abutment member on the container neck to prevent rotation of the cap relative to the container;

wherein the cap upper skirt and said first threaded neck portion are substantially cylindrical and each include eight threads having respective thread leads approximately 45° apart around the respective circumferences thereof, each of said threads on said cap and container neck being modified buttress threads, said upper skirt portion having a vertical dimension not greater than approximately 460 thousandths of an inch, said cap being affixable to said container neck by direct axial displacement without rotation of said cap relative to said neck such that the internal and external threads slip past each other and interengage, whereby good sealing engagement of the valve to the container neck is achieved without further tightening of said cap on said container neck and wherein the lower skirt portion includes at least three pull-tabs symmetrically disposed thereabout, the lower skirt further including a tear initiation groove adjacent each of said pull-tabs, whereby a pulling force on one of said pull-tabs breaks said corresponding tear initiation groove thereby facilitating annular tearing along the frangible line of weakness to separate the lower skirt portion from the upper skirt in one continuous strip.

11. The combination of claim 10, wherein the abutment members on the cap and container prevents both clockwise and counter-clockwise rotation of said cap relative to the container neck.

12. The combination of claim 10, wherein the upper skirt portion of the container cap has a diameter of approximately 38 mm.

13. The combination of claim 10, wherein each thread of the cap includes an engagement surface sloped approximately ten angular degrees above a horizontal and a downwardly sloped lower portion approximately fifty-three angular degrees below the horizontal.

14. The combination of claim 10, wherein the engagement of the respective abutment members on the cap and container prevent rotation of the cap relative to the container in both a clockwise and counter-clockwise direction.

15. The combination of claim 10, wherein each of the leads on the cap and container neck extend approximately 180° around respective circumferences thereof.

16. In combination, a container having an opening and a cap, the cap comprising a top surface, an upper skirt depending downwardly from said top surface, and a tamper-indicating lower skirt depending downwardly from the upper skirt, the lower skirt being frangibly connected to the upper skirt along a line of weakness;

the container and cap including cooperative threads for removal and replacement engagement therebetween, the container and lower skirt of the cap including interengaging abutment members for preventing removal of said cap unless said upper and lower skirts are disconnected at said line of weakness;

wherein the lower skirt includes at least three pull-tabs substantially symmetrically disposed thereabout, the lower skirt further including a tear initiation groove adjacent each of said pull-tabs, each of the tear initiation grooves vertically traversing said lower skirt, each of the tear initiation grooves being stronger than said line of weakness so that upon pulling on any pull tab, the adjacent vertical tear initiation groove is first broken followed by removal of the tamper-indicating ring from the upper skirt by breaking along the line of weakness while the remaining tear initiation grooves remain intact and the frangible ring is completely removed from the upper skirt in a single piece.

17. The combination of claim 16, wherein the interengaging abutment members prevent both clockwise and counter-clockwise rotation.

18. The combination of claim 17, wherein the abutment member of the cap comprises at least one lug, the lug having parallel opposed side walls which taper downwardly to a point.

19. The combination of claim 17, wherein the abutment member of the cap comprises a plurality of lugs, the upper portions of each lug forming the frangible line weakness coupling the lower skirt to the upper skirt.

20. The combination of claim 16, wherein the container and cap each include an eight lead thread.

21. The combination of claim 20, wherein each of the threads is a modified buttress thread.

22. The combination of claim 16, wherein each of said eight thread leads is approximately 180 angular degrees in length.

23. The combination of claim 16, wherein each of said pull-tabs are oriented in the same direction.

* * * * *